United States Patent [19]

Grosshans

[11] Patent Number: 4,650,071

[45] Date of Patent: Mar. 17, 1987

[54] CASE FOR WRITING UTENSILS

[76] Inventor: Jurgen Grosshans, Ludwigstrasse 7, 6078 Neu-Isenburg, Fed. Rep. of Germany

[21] Appl. No.: 718,343

[22] Filed: Apr. 1, 1985

[51] Int. Cl.[4] ..... A45C 11/36; B65D 85/30

[52] U.S. Cl. ..... 206/214; 206/45.19; 206/563; 220/338

[58] Field of Search ..... 206/214, 224, 45.19, 206/563, 564, 45.33; 220/338, 337

[56] References Cited

U.S. PATENT DOCUMENTS

| | | | |
|---|---|---|---|
| 2,461,711 | 2/1949 | Wewetzer | 220/338 |
| 2,612,989 | 10/1952 | Harrison | 206/45.33 |
| 2,928,532 | 3/1960 | Varrieur | 206/45.19 |
| 3,612,335 | 10/1971 | Schurman | 220/338 |
| 3,732,999 | 5/1973 | Rounkles | 220/338 |
| 3,744,663 | 7/1973 | Moren | 206/45.19 |
| 3,759,413 | 9/1973 | Ardito | 206/45.19 |
| 4,132,311 | 1/1979 | Glinert | 206/563 |
| 4,159,769 | 7/1979 | Hatter et al. | 206/563 |
| 4,220,253 | 9/1980 | Thomas et al. | 220/338 |
| 4,431,114 | 2/1984 | Kleinfeld | 220/337 |
| 4,511,036 | 4/1985 | Castelli | 206/214 |

FOREIGN PATENT DOCUMENTS

| | | | |
|---|---|---|---|
| 1010801 | 5/1977 | Canada | 220/338 |
| 3302107 | 7/1984 | Fed. Rep. of Germany | 206/214 |

*Primary Examiner*—William Price
*Assistant Examiner*—Brenda J. Ehrhardt
*Attorney, Agent, or Firm*—Larson and Taylor

[57] ABSTRACT

A case for packing small objects such as writing utensils, watches, lighters and the like. A lower part made from a deep-drawn foil material has vertical side walls and a centrally arranged trough-shaped depression and constitutes at least a partial structural support for the casing. Further support is provided by a relatively stiff bottom part. The lower part has a step shoulder along at least one edge and hinge recesses in the two side walls adjoining that edge and aligned with the step shoulder. A lid, preferably of a stiffer material, has a pair of opposed hinge pins along one edge, which hinge pins are received in the recesses as the said edge of the lid is supported at least in part on the step shoulder. The lower part may have additional step shoulders along other side walls to support the lid in the closed position thereof.

6 Claims, 1 Drawing Figure

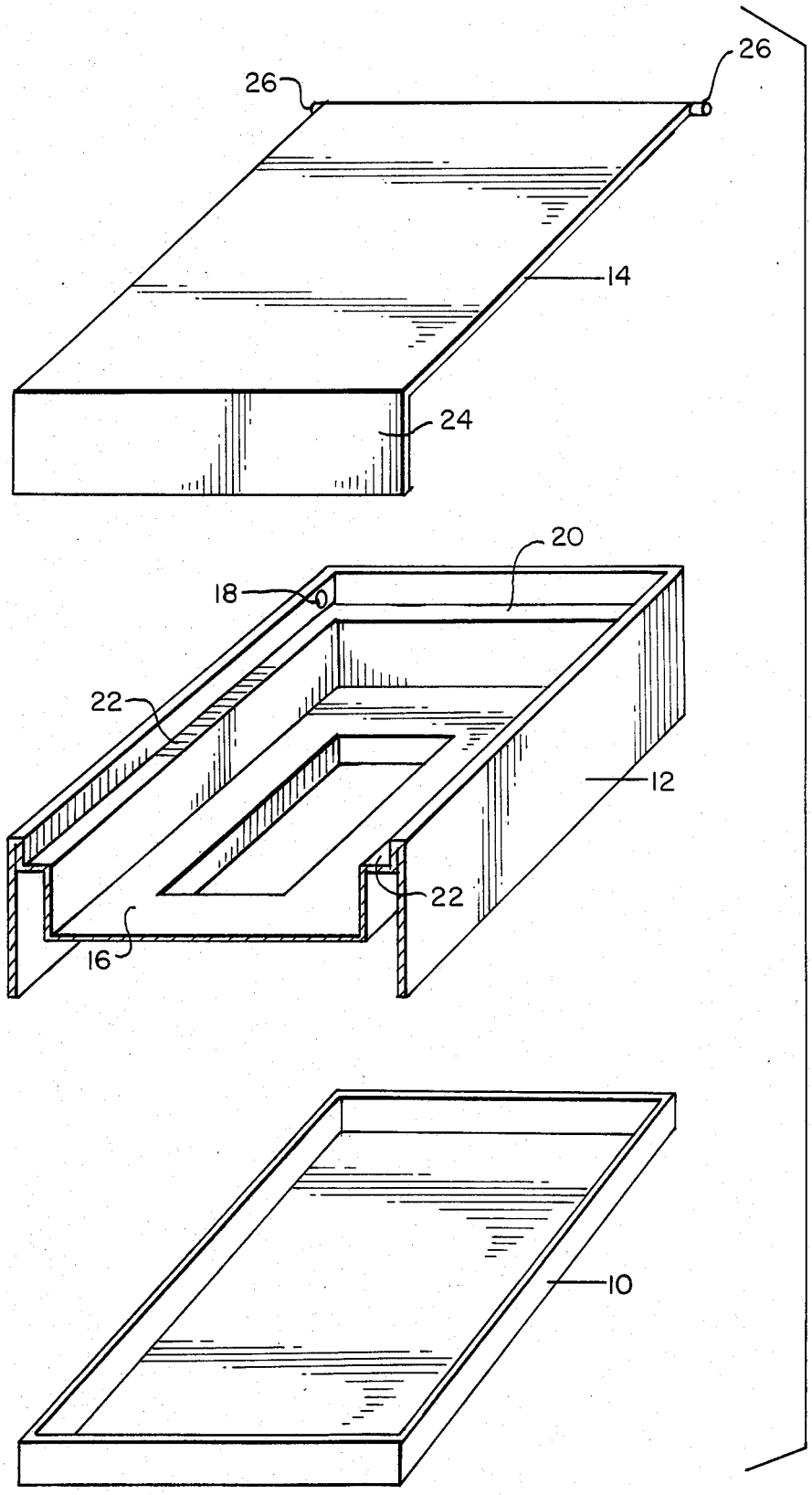
26
26
14
24
20
18
22
12
22
16
10

CASE FOR WRITING UTENSILS

DESCRIPTION

The invention refers to a case for writing utensils, lighters, watches and the like, consisting of a lower part and a lid.

Most commonly such cases are manufactured from solid injection-moulded parts or from sheet metal. The lid is either a hooded lid or attached to the lower part by means of hinges. A cushion-like padding often consisting of deep-drawn foil with a textured finish such as a velvety surface is inserted into the parts of the case.

Especially because of the high tool cost for injection-moulded parts but also because of the comparatively high cost of the injection-moulding process proper the cases as known in the present state of the art are relatively expensive. For cases with hinges between the lid and bottom parts the deep-drawing process when manufacturing such case parts had to be ruled out anyway because a deep-drawn case part made of the thin deep-drawing foil with a thickness of, say, 0.4 mm which would have been the material to be used here cannot sufficiently support a hinge mechanism.

Hence, the invention is based on the task of creating a case which not only has an appealing look but may be, in spite of having one or several hinges, manufactured considerably easier, faster and less expensive as compared to the models known heretofore.

The aforesaid task is met according to the invention in that the lower part comprises a deep-drawn foil which is formed into essentially vertical side walls with a structural supporting function and with a centrally arranged trough-shaped depression; the bottom side of said lower part being closed and mounted by a stiff bottom part and showing on its upper side at the edge of said trough-shaped depression on one of the interior walls a stepped shoulder, near which recesses are arranged in both neighbouring interior walls and into said recesses hinge pivots provided on a tilting lid may be engaged, whereby the edge of the lid between the hinge pivots will, at least in part, rest on said stepped shoulder.

The special character of the invention is determined by the fact that, because of the proposed arrangement of the hinge near a stepped shoulder at the lower part of the case, the hinge components will be relieved to such extent that the lower part of the case together with the recesses for the hinges may be formed from a thin foil in a deep-drawing process. Stiffening of the lower case is provided by the bottom part which may be a very simple injection-moulded part. The lid with its integrated hinge pivots, too, may be injection-moulded. It should be inherently stiff, though.

If a pressure is exerted on the lid towards the lower part, the lid is supported by its backside edge resting on the stepped shoulder between the recesses in the interior side walls of the lower part of the case which receive the hinge pivots of the lid.

It may suffice if the lid is supported only by a portion of its backside edge resting on the stepped shoulder of the lower part of the case; it should be preferred, however, to utilize the entire interior width of the lower part of the case for supporting functions. Thus, the stepped shoulder, in addition to its function as a supporting surface for the lid which is rounded off at its backside edge, forms part of the hinge.

In a preferred practical execution of the invention the closed lid is supported all around by the lower part of the case. If then, with the lid being closed, any pressure is exerted on the case, the resulting forces are distributed over the four side walls of the lower part of the case and this will be essentially without any load on the hinge.

Following hereafter the invention is described more in detail by means of the drawing. This drawing shows, in an exploded perspective view, those parts of which the case consists. In detail, these are a bottom part (10), a lower part (12), and a lid (14).

The bottom part (10) has the simple rectangular shape shown in the drawing and comprises a closed bottom plate and low side walls. Preferrably the bottom part will be injection-moulded; it may be possible, however, to consider other manufacturing processes and shapes. the only important point is that the bottom part (10), into which the lower part (12) will be inserted, offers a rigidity and strength sufficient for the intended use to support the four side walls of the lower part (12) and to avoid their deformation when being under load. The lower part (12) may be locked in place with the bottom part (10) by means of matching projections and recesses not shown here.

The lower part (12) possesses four exterior and essentially vertical walls, the front wall of which has been left out in the drawing in order to show the sectional view. In the center area the lower part (12) is shaped to have a trough-shaped depression (16) which will accept the item to be packed in the case. At the end of the trough-shaped depression (16) shown as being the rear end in the drawing, and next to the upper edge, two small recesses (18) are provided in the interior side walls in juxtaposition, only the left one of which being visible in the drawing. Between the recesses (18) and along the interior backside wall a stepped shoulder (20) is extending, to be continued by connecting similar stepped shoulders (22) at the same level all around the interior side walls. The front wall which is not shown here extends from the lower edge up to the level of the stepped shoulder (22) and possesses, somewhere at a lower level, another stepped shoulder which supports the bent-down front end (24) of the lid (14) in its closed position.

The lower part (12) consists preferrably of deep-drawn foil material with a finished surface such as of a velvety or grained nature. In order to safely keep in place the item resting in the trough-shaped depression (16) it may be useful to add suitable projections not shown in the drawing which will lock in place the item when being inserted.

The backside edge of the lid (14) is provided with hinge pivots (26) projecting on both sides. In the example the backside edge of the lid (14) has been formed rounded and concentrically to the hinge axis defined by the hinge pivots (26). When installing the stiff lid (14) which may be manufactured, for example by an injection-moulding process, the short hinge pivots (26) are received by the recesses (18) whereby the backside edge of the lid (14) will rest gently upon the stepped shoulder (20). In a closed position of the lid (14) its side edges, too, are supported by the stepped shoulders (22) and the bent-down front part (24) of the lid rests on the lower exterior shoulder mentioned above which is located at the front wall of the lower part (12).

It is understood that shape and size of the trough-shaped depression as well as of the entire case will depend on the nature of the item to be accepted. Replacing the heretofore injection-moulded lower part and is deep-drawn cushion-like padding by a lower part made from deep-drawn foil as it is possible now because of the proposed design of the hinge results in a considerable saving of costs since such cases are manufactured in large quantities.

What is claimed is :

1. A case for packing small objects such as writing utensils, watches, lighters and the like, comprising:

a lower part made of a thin deep-drawn foil material shaped to form essentially vertical side walls and a centrally arranged trough-shaped depression, said side walls and depression comprising at least a partial structural support for the case, a bottom part which is substantially stiffer than the lower part, said bottom part connected to and closing the bottom of the lower part to provide further structural support for the case, said lower part having a step shoulder near the upper edge of at least one of said vertical walls, a pair of hinge recesses formed in the two vertical walls adjacent said one wall and substantially aligned with said step shoulder, a lid having a pair of opposed hinge pins extending outwardly from and generally parallel to one edge of said lid, wherein said hinge pins are located in said hinge recesses and said one edge rests, at least in part, on said step shoulder.

2. A case according the claim 1, wherein to said one edge of the lid is supported by said step shoulder along the complete length of said one edge.

3. A case according to claim 1, including a pair of further step shoulders at the same height of said step shoulder and located in said two vertical walls adjacent said one vertical wall, and wherein the two edges of the lid adjacent said one edge rest on the further step shoulders when the lid is closed.

4. A case according to claim 1, said lid being of a material substantially stiffer than the lower part.

5. A case according claim 1, said one edge of the lid being rounded off and essentially concentric with the axis of its said hinge pins.

6. A case according to claim 1, wherein said one edge of the lid is supported by said one step shoulder along its complete length, said lid being of a material substantially stiffer than the lower part and said one edge of the lid being rounded and essentially concentric with the axis of its said hinge pins, and including further step shoulders at the same height as said one step shoulder and located on two vertical side walls adjacent said one vertical side wall, and wherein the two edges of the lid adjacent said one edge thereof rest on the further step shoulders when the lid is closed.

* * * * *